United States Patent [19]

Kubiatowicz

[11] 4,194,461

[45] Mar. 25, 1980

[54] DOOR ALARM TOY

[75] Inventor: James F. Kubiatowicz, Minneapolis, Minn.

[73] Assignee: Custom Concepts, Incorporated, Minneapolis, Minn.

[21] Appl. No.: 897,791

[22] Filed: Apr. 19, 1978

[51] Int. Cl.[2] ..... A63H 5/00; G08B 13/08

[52] U.S. Cl. ..... 116/77; 46/175 R; 46/179; 116/86

[58] Field of Search ..... 116/86, 85, 100, DIG. 9, 116/DIG. 8, 77; 46/179, 88, 90

[56] References Cited

U.S. PATENT DOCUMENTS

| | | | |
|---|---|---|---|
| 439,503 | 10/1890 | Griffith | 116/77 |
| 868,543 | 10/1907 | Geiger | 116/77 |
| 1,098,286 | 5/1914 | Miller | 116/DIG. 9 |
| 1,543,954 | 6/1925 | Shira | 116/DIG. 9 |
| 2,519,324 | 8/1950 | Smith, Jr. | 46/179 |
| 3,169,509 | 2/1965 | Rich | 116/137 A |
| 3,172,588 | 3/1965 | Beefold et al. | 425/806 R X |
| 4,108,104 | 8/1978 | Kupperman et al. | 116/DIG. 12 X |

FOREIGN PATENT DOCUMENTS

| | | | |
|---|---|---|---|
| 148974 | 11/1952 | Australia | 46/88 |
| 648477 | 1/1951 | United Kingdom | 46/88 |

*Primary Examiner*—Daniel M. Yasich
*Attorney, Agent, or Firm*—William L. Huebsch

[57] ABSTRACT

A door alarm toy comprising a whistle adapted to be sounded by air escaping from an inflated balloon; and a clip adapted for engagement between a door and its door frame to hang the toy with an inflated balloon pressed against the door to frictionally retain a twist in the balloon which prevents it from deflating. When the door is then opened, the toy drops, the balloon untwists and air escaping from the balloon sounds the whistle.

6 Claims, 7 Drawing Figures

DOOR ALARM TOY

BACKGROUND OF THE INVENTION

This invention relates to whistles sounded by air escaping from inflated toy balloons, and to the structure of such whistles.

The closest known prior art are party noisemakers including whistles fixed at the outlet openings of toy balloons which will be sounded by deflation of the balloon.

SUMMARY OF THE INVENTION

The present invention provides a door alarm toy including a whistle adapted to be operated by air escaping from a balloon, which toy is adapted to be fixed to a closed door and to prevent escape of air from the balloon until the door is opened; whereupon, the balloon is allowed to deflate and sound the whistle, signaling to persons in the area that the door has been opened. Such a signal may be a source of amusement (as to a youngster) or provide information of interest (as to the parents of a nocturnally returning son or daughter) relating to the person opening the door.

The door alarm toy according to the present invention includes means attached to the whistle and adapted to be inserted in the space between the door and its frame to engage the door and frame and hang the toy after the balloon has been inflated and twisted adjacent the whistle, so that the balloon will frictionally engage the door or frame to retain the twist and thereby prevent air from excaping the balloon. When the door is then opened, the toy will drop and the balloon will untwist and deflate to sound the whistle.

Preferably, the whistle is of a novel integral structure of polymeric material including a first tubular portion having a closed end and an open end; a second tubular portion including a flange adapted to be inserted in the opening of the balloon with the neck of the balloon stretched about it, a collar at its end opposite the flange adapted for frictional telescoping engagement with the open end portion of the first tubular portion, and a transverse wall between the flange and collar having an air inlet opening or flue; and a thin flexible portion joining the tubular portions for movement between a mold or disengaged portion with the tubular portions spaced from each other in exially parallel relationships (in which position the whistle may be easily molded by the injection molding process), and an assembled position with the collar engaging the first tubular portion.

Also preferably the means adapted to be inserted between the door and frame to hang the toy includes a resilient generally V-shaped clip fixed to one of the tubular portions and adapted to be compressed between the door and the frame.

BRIEF DESCRIPTION OF THE DRAWING

The present invention will be further described with reference to the accompanying drawing wherein like numbers refer to like parts in the several views, and wherein.

DESCRIPTION OF THE PREFERRED EMBODIMENT

Figure 1:
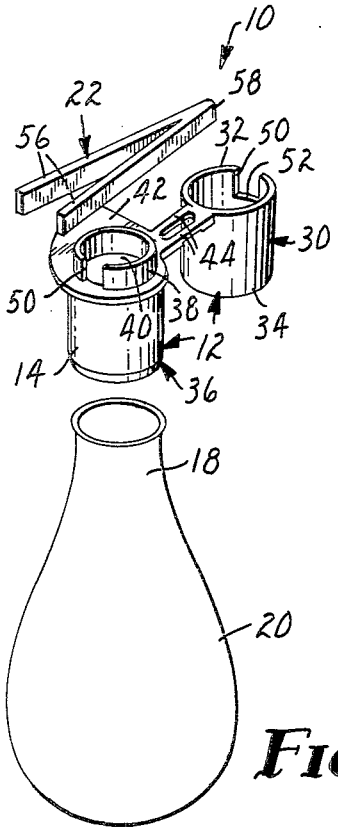
FIG. 1 is a perspective view of a Door Alarm Toy according to the present invention shown with tubular portions of the toy shown in a disengaged position and adjacent a balloon.

Referring now to the drawing, there is shown a Door Alarm Toy according to the present invention generally designated by the reference numeral 10.

Figure 6:
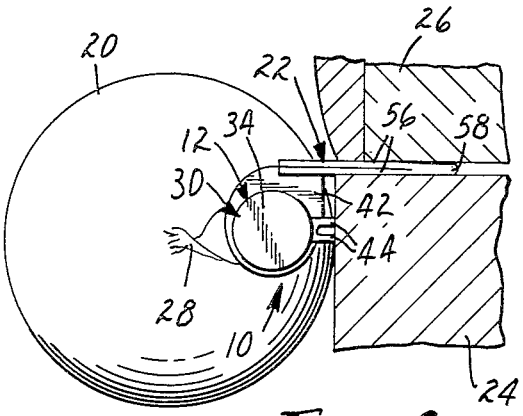
FIG. 6 is a top view of the Door Alarm Toy as shown in FIG. 5.
Figure 7:
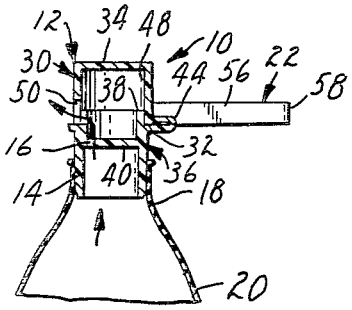
FIG. 7 is a sectional view of the Door Alarm Toy of FIG. 1 after the door of FIGS. 5 and 6 has been opened to allow the toy to drop and air from the inflated balloon to be discharged through a whistle in the toy.
Figure 5:
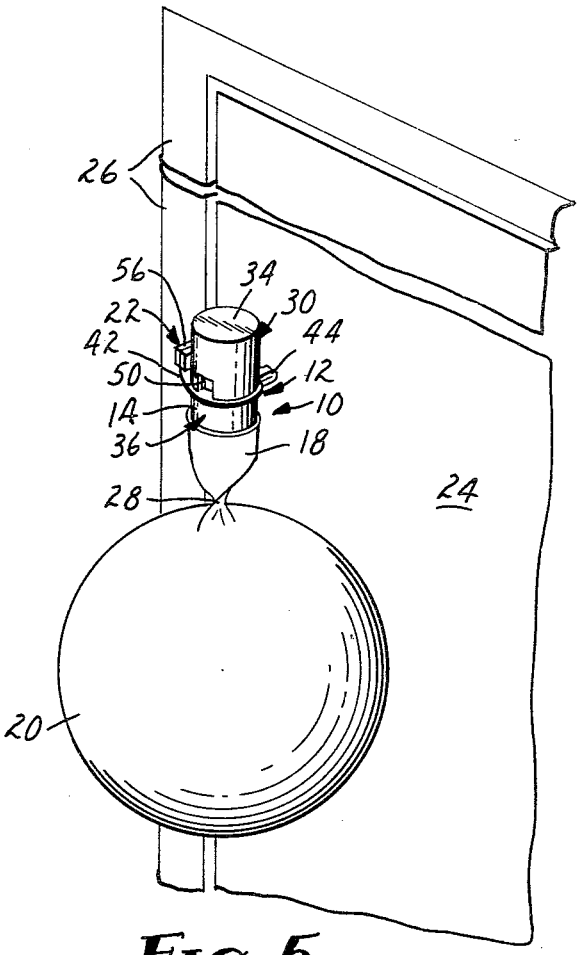
FIG. 5 is a perspective view of the Door Alarm Toy of FIG. 1 with the portions in an engaged position, an inflated twisted balloon attached to the toy, and the toy hanging adjacent a closed door.

As is most easily seen in FIGS. 5 and 6, the door alarm toy 10 when assembled comprises a whistle portion or whistle 12 having a flange 14 around an air inlet opening or flue 16 (FIGS. 2, 3 and 7) over which flange 14 is stretched the neck 18 of a resilient elastic rubber balloon 20. Also included is a resilient clip portion or clip 22 attached to the whistle 12 which provides means adapted to be inserted and compressed in the space between a door 24 and a frame 26 around the door 24 to position one side of the flange 14 along the outer surface of the door 24 or frame 26. When the balloon 20 is sequentially inflated and twisted adjacent the flange 14 in the area designated 28 in FIGS. 5 and 6, and the clip portion 22 is then inserted in the space between the door 24 and frame 26 with a portion of the side surface of the balloon 20 spaced from the flange 14 pressed against and in frictional engagement with the outer surface of the door 24 or frame 26, friction between the balloon 20 outer surface of and the door 24 and/or frame 26 will prevent the balloon 20 from rotating to untwist the area 28, and said friction and the twisted portion 28 will provide the only means for keeping the balloon 20 inflated. Subsequently, when the door 24 is opened, the toy 10 will drop. The twisted portion 28 of the balloon 20 will straighten, allowing the balloon 20 to deflate through and sound the whistle 12 (FIG. 7) as a signal to persons in the area that the door 24 has been opened.

Figure 2:
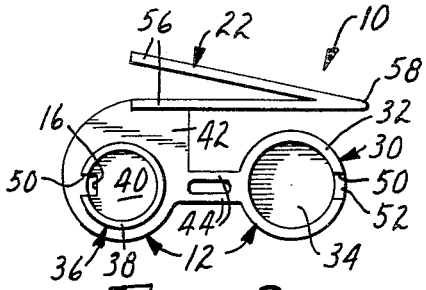
FIG. 2 is a top view of the Door Alarm Toy of FIG. 1.
Figure 3:
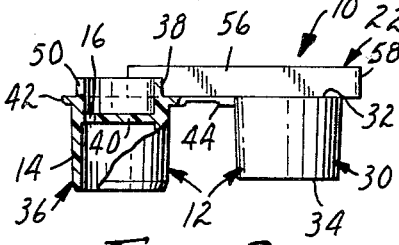
FIG. 3 is a side view of the Door Alarm Toy of FIG. 1 having parts broken away to show details.
Figure 4:
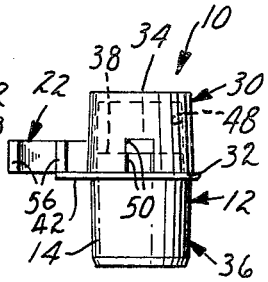
FIG. 4 is a left end view of the Door Alarm Toy of FIG. 1 shown with portions of the toy in an engaged position.

As is best seen in FIGS. 1 through 3, the whistle portion 12 and clip portion 22 are an integral molding of a stiff flexible resilient polymeric material (e.g. polypropylene). The molding comprises a first cylindrically tubular portion 30 having a central axis, an open end part 32, and an end wall 34 providing a closed end; and a second stepped cylindrically tubular portion 36 including the flange 14 at one end, a collar 38 at its end opposite the flange 14 the outer surface of which is adapted for telescoping frictional engagement with the inner surface of the end part 32, and a transverse wall 40 within and adjacent the proximal end of the flange 14 having the air inlet flue 16 adjacent one edge. Also included is a radially outwardly projecting plate-like portion 42 between the flange 14 and the collar 38 which serves as a stop for the open end part 32 of the first tubular portion 30 when it engages the collar 38, and to which is fixed the clip portion 22, and a thinned flexible hinge portion 44 attached at its other end to the first tubular portion 30. The hinge portion 44 joins the tubular portions 30 and 36 for movement between a molded or spaced position (FIGS. 1, 2 and 3) with the tubular portions 30 and 36 spaced from each other and their axes parallel; and an assembled position with the collar 38 engaging the first tubular portion 30 (FIGS. 4 through 7).

When the tubular portions 30 and 36 are in their engaged position, the first tubular portion 30, the collar 38 and the transverse wall 40 define a resonant whistle chamber 48 therebetween into which air enters through the air inlet flue 16.

The collar 38 and the first tubular portion 30 both have an opening 50 with straight, normally disposed sides, which openings 50 are aligned when the tubular portions 30 and 36 are engaged (due to the locating influence of the hinge portion 44) to provide an air outlet opening for air in the whistle chamber. The air inlet flue 16, the air outlet opening, and a lip 52 for the whistle (which lip 52 is provided by a novel flat rectangular surface at the end of the opening 50 in the first tubular portion 30 adjacent its end wall 34) are disposed in a conventional relationship for a whistle and are sized and shaped to produce a desired pitch.

The clip portion 22 of the molding comprises two elongate members 56 having joined ends 58 to provide a general V-shape for the clip 22, with the end of one of the members 56 opposite the joined ends 58 being fixed to the whistle 12 via the plate-like portion 42. The combined thickness of the members 56 and the spread between their unjoined ends is adapted so that the clip portion 22 can be inserted, joined end 58 first, in the space that exists between most doors and their frames, with one of the elongate members 56 adjacent the door and the other adjacent the frame, and with the door and frame pressing the resilient members together so that they will engage the door and frame with sufficient force to hang the toy 10.

As is best seen in FIGS. 1 through 4, the walls of the molding are aligned either normal or parallel to the axes of the tubular portions 30 and 36 which facilitates molding since its mold may be easily separated in a direction parallel to the axes of the tubular portions 30 and 36.

I claim:

1. An assembled door alarm toy comprising in combination:

a resilient elastic balloon having a neck portion adjacent an opening;

an air operated whistle having an air inlet flue and a flange around said air inlet flue inserted in the opening of said balloon with the neck of the balloon stretched about said flange; and means attached to said whistle adapted to be inserted and compressed in the space between a door and a frame around the door for frictionally engaging the adjacent surfaces of both the door and the frame with one side of the flange positioned along the outer surface of the door or frame so that with said balloon inflated and twisted adjacent said flange, and said means attached to said whistle inserted in said space with a portion of the side surface of the balloon spaced from the flange pressed against and in frictional engagement with the outer surface of the door or frame, friction between said side surface of the balloon and the door or frame will prevent the balloon from rotating to remove the twist in the balloon and said friction and twist will provide the only means for maintaining the balloon in an inflated condition until the door is opened, whereupon the toy will fall, the balloon will untwist and deflation of the balloon will sound the whistle.

2. A door alarm toy according to claim 1 wherein said means comprises two elongate members of flexible resilient material having joined ends to provide a generally V-shaped clip with the end of one of said members opposite said joined ends fixed to said whistle, said clip being adapted to be inserted between a door and a door frame with one of said elongate members engaging the door and the other engaging the door frame and with the door and frame pressing said members together.

3. A door alarm toy according to claim 1 or claim 2 wherein said whistle is an integral molding comprising a first tubular portion having a closed end and an open end; a second tubular portion including said flange at one end, a collar at its end opposite said flange adapted for telescoping frictional engagement with said first tubular portion adjacent its open end, and a transverse wall between said flange and said collar having said air inlet flue; and a thin flexible portions joining said tubular portion for movement between a spaced position with said tubular portions spaced from each other and an assembled position with said collar engaging said first tubular portion.

4. A door alarm toy comprising:

an air operated whistle having an air inlet flue and a flange around said air inlet flue adapted for insertion in the opening of a balloon with its neck stretched about said flange; and means attached to said whistle adapted to be inserted and compressed in the space between a door and a frame around the door for frictionally engaging the adjacent surfaces of both the door and the frame with one side of the flange positioned along the outer surface of the door or frame so that with a said balloon engaged around said flange, inflated, and twisted adjacent said flange, and said means attached to said whistle inserted in said space, with a portion of the side surface of the balloon spaced from the flange pressed against and in frictional engagement with the outer surface of the door or frame, friction between the side surface of the balloon and the door or frame will prevent the balloon from rotating to remove the twist in the balloon and said friction and twist will provide the only means for maintaining the balloon in an inflated condition until the door is opened, whereupon the toy will fall, the balloon will untwist, and deflation of the balloon will sound the whistle.

5. A door alarm toy according to claim 4 wherein said means comprises two elongate members of flexible resilient material having joined ends to provide a generally V-shaped clip with the end of one of said members opposite said joined ends fixed to said whistle, said clip being adapted to be inserted between a door and a door frame with one of said elongate members engaging the door and the other engaging the door frame and with the door and frame pressing said members together.

6. A door alarm toy according to claim 4 or claim 8 wherein said whistle is an integral molding comprising a first tubular portion having a closed end and an open end; a second tubular portion including said flange at one end, a collar at its end opposite said flange adapted for telescoping frictional engagement with said first tubular portion adjacent its open end, and a transverse wall between said flange and said collar having said air inlet flue; and a thin flexible portion joining said tubular portion for movement between a spaced position with said tubular portions spaced from each other and an assembled position with said collar engaging said first tubular portion.

* * * * *